US010538854B2

(12) United States Patent
Sakurai et al.

(10) Patent No.: US 10,538,854 B2
(45) Date of Patent: Jan. 21, 2020

(54) COPPER-NICKEL ALLOY ELECTROPLATING DEVICE

(71) Applicant: Dipsol Chemicals Co., LTD., Tokyo (JP)

(72) Inventors: Hitoshi Sakurai, Chiba (JP); Kazunori Ono, Tokyo (JP); Akira Hashimoto, Chiba (JP); Satoshi Yuasa, Chiba (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 57 days.

(21) Appl. No.: 15/519,474

(22) PCT Filed: Jun. 25, 2015

(86) PCT No.: PCT/JP2015/068332

§ 371 (c)(1),
(2) Date: Apr. 14, 2017

(87) PCT Pub. No.: WO2016/059833

PCT Pub. Date: Apr. 21, 2016

(65) Prior Publication Data

US 2017/0241040 A1 Aug. 24, 2017

(30) Foreign Application Priority Data

Oct. 17, 2014 (JP) ..... 2014-212524

(51) Int. Cl.
*C25D 21/14* (2006.01)
*C25D 3/58* (2006.01)
(Continued)

(52) U.S. Cl.
CPC ..... *C25D 21/14* (2013.01); *C22C 9/06* (2013.01); *C22C 19/002* (2013.01); *C22C 19/03* (2013.01);
(Continued)

(58) Field of Classification Search
CPC ..... C22C 9/06; C22C 19/002; C22C 19/03; C25D 3/562; C25D 3/58; C25D 5/08; C25D 17/00; C25D 17/002; C25D 17/008; C25D 21/06; C25D 21/10; C25D 21/12; C25D 21/14
See application file for complete search history.

(56) References Cited

U.S. PATENT DOCUMENTS 8,128,791 B1 3/2012 Buckalew et al.
2002/0027080 A1 3/2002 Yoshioka et al.
(Continued)

FOREIGN PATENT DOCUMENTS

JP H04-198499 7/1992
KR 2001-0034399 4/2001
(Continued)

OTHER PUBLICATIONS

Extended European Search Report issued on EP 15849917.8 dated May 2, 2018.
(Continued)

*Primary Examiner* — Ciel P Thomas
(74) *Attorney, Agent, or Firm* — Foley & Lardner LLP

(57) ABSTRACT

Provided is a copper-nickel alloy electroplating apparatus which is capable of stably forming a copper-nickel plated coating on a workpiece with a uniform composition and which enables a plating bath to be used for a long period. The present invention provides a copper-nickel alloy electroplating apparatus (1), comprising: a cathode chamber (4) in which a workpiece (5) is to be placed; an anode chamber (6); an anode (7) placed in the anode chamber; an electrically conductive diaphragm (14) placed to separate the cathode chamber and the anode chamber from each other; a cathode chamber oxidation-reduction potential adjusting tank (8) for adjusting the oxidation-reduction potential of a plating liquid in the cathode chamber; an anode chamber oxidation-reduction potential adjusting tank (10) for adjusting the oxidation-reduction potential of a plating liquid in the anode chamber; and a power supply unit (36) that provides an electric current to flow between the workpiece and the anode.

6 Claims, 2 Drawing Sheets

(51) Int. Cl.

| | |
|---|---|
| ***C22C 9/06*** | (2006.01) |
| ***C22C 19/00*** | (2006.01) |
| ***C22C 19/03*** | (2006.01) |
| ***C25D 3/56*** | (2006.01) |
| ***C25D 17/00*** | (2006.01) |
| ***C25D 21/12*** | (2006.01) |
| ***C25D 21/06*** | (2006.01) |
| ***C25D 21/10*** | (2006.01) |
| *C25D 5/08* | (2006.01) |

(52) U.S. Cl.
CPC ..... *C25D 3/562* (2013.01); *C25D 3/58* (2013.01); *C25D 17/00* (2013.01); *C25D 17/002* (2013.01); *C25D 17/008* (2013.01); *C25D 21/06* (2013.01); *C25D 21/10* (2013.01); *C25D 21/12* (2013.01); *C25D 5/08* (2013.01)

(56) References Cited

U.S. PATENT DOCUMENTS

| | | | | |
|---|---|---|---|---|
| 2004/0007473 | A1 | 1/2004 | Yang | |
| 2004/0022940 | A1* | 2/2004 | Nagai ..... | C25D 3/38 427/230 |
| 2005/0082163 | A1 | 4/2005 | Yoshioka et al. | |
| 2008/0245669 | A1 | 10/2008 | Yoshioka et al. | |
| 2012/0216997 | A1* | 8/2012 | Suwa ..... | C25D 3/02 165/185 |
| 2012/0234683 | A1* | 9/2012 | Lien ..... | C25D 7/123 205/83 |
| 2015/0090600 | A1 | 4/2015 | Inoue et al. | |

FOREIGN PATENT DOCUMENTS

| | | |
|---|---|---|
| KR | 2001-0090469 | 10/2001 |
| TW | I281516 | 5/2007 |
| TW | 201402878 A | 1/2014 |
| WO | WO-2013/157639 A1 | 10/2013 |

OTHER PUBLICATIONS

Korean Office Action on Appl. No. 10-2017-7009288 dated Mar. 9, 2018.

Office Action, issued in Taiwanese Patent Application No. 104125581, 9 pages (dated Oct. 12, 2018).

Chinese Office Action, issued in Chinese Patent Application No. 201580055714.5, 13 pages (dated Feb. 22, 2019).

* cited by examiner

COPPER-NICKEL ALLOY ELECTROPLATING DEVICE

This application is a U.S. National Stage of International Application No. PCT/JP2015/068332, filed on Jun. 25, 2015, designating the United States, and claiming the benefit of Japanese Patent Application No. 2014-212524, filed with the Japanese Patent Office on Oct. 17, 2014, all of which are hereby incorporated by reference in their entireties.

TECHNICAL FIELD

The present invention relates to a plating apparatus, and particularly to a copper-nickel alloy electroplating apparatus.

BACKGROUND ART

Generally, by changing the ratio between copper and nickel, copper-nickel alloys are made to exhibit excellent properties in corrosion resistance, malleability/ductility, processability, and high temperature characteristics, and copper-nickel alloys also have characteristic properties in electric resistivity, coefficient of thermal resistance, thermal electromotive force, coefficient of thermal expansion, and the like. Thus, studies have hitherto been conducted to obtain such properties of copper-nickel alloys by electroplating. As conventionally attempted copper-nickel alloy electroplating baths, a large variety of baths have been studied, including a cyanide bath, a citric acid bath, an acetic acid bath, a tartaric acid bath, a thiosulfuric acid bath, an ammonia bath, a pyrophosphoric acid bath, and the like; however, none of these baths have been put into practical use.

The reasons why the copper-nickel alloy electroplating has not practically been used are as follows:

(1) copper and nickel differ from each other in deposition potential by approximately 0.6 V, so that copper is preferentially deposited;

(2) the plating bath is so unstable that insoluble compounds such as metal hydroxides are formed;

(3) the plating composition varies due to energization, so that a coating having a uniform composition cannot be stably obtained;

(4) the service life of the liquid is short; and the like.

SUMMARY OF INVENTION

Technical Problems

Because of the above-described problems, it is difficult for conventional electroplating apparatuses to stably obtain a copper-nickel plated coating on a workpiece with a uniform composition. It is also difficult to use a plating bath for a long period.

Solution to Problems

To solve the above-described problems, the present invention provides a copper-nickel alloy electroplating apparatus comprising: a cathode chamber in which a workpiece is to be placed; an anode chamber; an anode placed in the anode chamber; an electrically conductive diaphragm placed to separate the cathode chamber and the anode chamber from each other; a cathode chamber oxidation-reduction potential adjusting tank for adjusting the oxidation-reduction potential of a plating liquid in the cathode chamber; an anode chamber oxidation-reduction potential adjusting tank for adjusting the oxidation-reduction potential of a plating liquid in the anode chamber; and a power supply unit that provides an electric current to flow between the workpiece and the anode.

According to the thus configured present invention, the cathode chamber oxidation-reduction potential adjusting tank and the anode chamber oxidation-reduction potential adjusting tank adjust the oxidation-reduction potentials in the cathode chamber and the anode chamber, making it possible to obtain a plated coating with a uniform composition with copper and nickel being deposited onto a workpiece at any alloy ratio. In addition, since the oxidation-reduction potentials are adjusted, the bath state can be maintained stably, and also a good copper-nickel alloy electroplated coating can be obtained even when the plating bath (plating liquid) is continuously used for a long period.

In the present invention, it is preferable to further comprise a cathode chamber circulation device that circulates a plating liquid in the cathode chamber and the cathode chamber oxidation-reduction potential adjusting tank therebetween, and an anode chamber circulation device that circulates a plating liquid in the anode chamber and the anode chamber oxidation-reduction potential adjusting tank therebetween.

According to the thus configured present invention, the circulation devices circulate the plating liquid in the cathode chamber and the cathode chamber oxidation-reduction potential adjusting tank therebetween and the plating liquid in the anode chamber and the anode chamber oxidation-reduction potential adjusting tank therebetween. Hence, each of the plating liquids on the cathode side and the anode side can be maintained uniform, so that a uniform plated coating can be obtained.

In the present invention, the diaphragm is preferably a cloth made of polyester, polypropylene, KANEKALON, SARAN, or PTFE, a neutral diaphragm, or an ion exchange membrane.

According to the thus configured present invention, the diaphragm can be formed at low costs.

In the present invention, the cathode chamber circulation device preferably includes: a cathode chamber weir portion that allows the plating liquid in the cathode chamber to overflow into the cathode chamber oxidation-reduction potential adjusting tank; a cathode chamber transfer device that transfers the plating liquid in the cathode chamber oxidation-reduction potential adjusting tank to the cathode chamber; and a cathode chamber filter device that filters the plating liquid transferred by the cathode chamber transfer device, and the anode chamber circulation device preferably includes: an anode chamber weir portion that allows the plating liquid in the anode chamber oxidation-reduction potential adjusting tank to overflow into the anode chamber; an anode chamber transfer device that transfers the plating liquid in the anode chamber to the anode chamber oxidation-reduction potential adjusting tank; and an anode chamber filter device that filters the plating liquid transferred by the anode chamber transfer device.

According to the thus configured present invention, the use of the cathode chamber oxidation-reduction potential adjusting tank and the anode chamber oxidation-reduction potential adjusting tank enables the oxidation-reduction potentials in the cathode chamber and the anode chamber to be easily maintained to suitable values.

In the present invention, the cathode chamber circulation device preferably includes: a cathode chamber first transfer device that transfers the plating liquid in the cathode chamber to the cathode chamber oxidation-reduction potential adjusting tank; a cathode chamber second transfer device that transfers the plating liquid in the cathode chamber oxidation-reduction potential adjusting tank to the cathode chamber; and a cathode chamber filter device that filters the plating liquid circulated between the cathode chamber and the cathode chamber oxidation-reduction potential adjusting tank, and the anode chamber circulation device preferably includes: an anode chamber first transfer device that transfers the plating liquid in the anode chamber oxidation-reduction potential adjusting tank to the anode chamber; an anode chamber second transfer device that transfers the plating liquid in the anode chamber to the anode chamber oxidation-reduction potential adjusting tank; and an anode chamber filter device that filters the plating liquid circulated between the anode chamber and the anode chamber oxidation-reduction potential adjusting tank.

According to the thus configured present invention, the use of the cathode chamber oxidation-reduction potential adjusting tank and the anode chamber oxidation-reduction potential adjusting tank enables the oxidation-reduction potentials in the cathode chamber and the anode chamber to be easily maintained to suitable values. In addition, by using the transfer devices, the plating liquids are circulated between the cathode chamber and the cathode chamber oxidation-reduction potential adjusting tank and between the anode chamber and the anode chamber oxidation-reduction potential adjusting tank. Hence, the cathode chamber oxidation-reduction potential adjusting tank and the anode chamber oxidation-reduction potential adjusting tank can be placed at any positions.

In the present invention, it is preferable to further comprise: a cathode chamber electric potential measuring device that measures the oxidation-reduction potential of the plating liquid in the cathode chamber; an anode chamber electric potential measuring device that measures the oxidation-reduction potential of the plating liquid in the anode chamber; a cathode chamber adjusting agent addition device that adds an oxidation-reduction potential adjusting agent to the cathode chamber oxidation-reduction potential adjusting tank; an anode chamber adjusting agent addition device that adds an oxidation-reduction potential adjusting agent to the anode chamber oxidation-reduction potential adjusting tank; and a control unit that controls the cathode chamber adjusting agent addition device and the anode chamber adjusting agent addition device on the basis of the oxidation-reduction potential measured by the cathode chamber electric potential measuring device and the oxidation-reduction potential measured by the anode chamber electric potential measuring device.

According to the thus configured present invention, the oxidation-reduction potentials in the cathode chamber and the anode chamber can be maintained precisely to suitable values.

In the present invention, it is preferable to further comprises a copper-nickel alloy electroplating liquid contained in the cathode chamber, the anode chamber, the cathode chamber oxidation-reduction potential adjusting tank, and the anode chamber oxidation-reduction potential adjusting tank, wherein the copper-nickel alloy electroplating liquid comprises: (a) a copper salt and a nickel salt, (b) a metal complexing agent, (c) a conductivity providing salt, and (d) a sulfur-containing organic compound.

The thus configured present invention makes it possible to obtain a good copper-nickel alloy electroplated coating.

Advantageous Effects of Invention

The copper-nickel alloy electroplating apparatus of the present invention is capable of stably forming a copper-nickel plated coating on a workpiece with a uniform composition, and also enables a plating bath to be used for a long period.

DESCRIPTION OF EMBODIMENTS

Next, copper-nickel alloy electroplating apparatuses according to preferred embodiments of the present invention are described with reference to the attached drawings.

Figure 1:
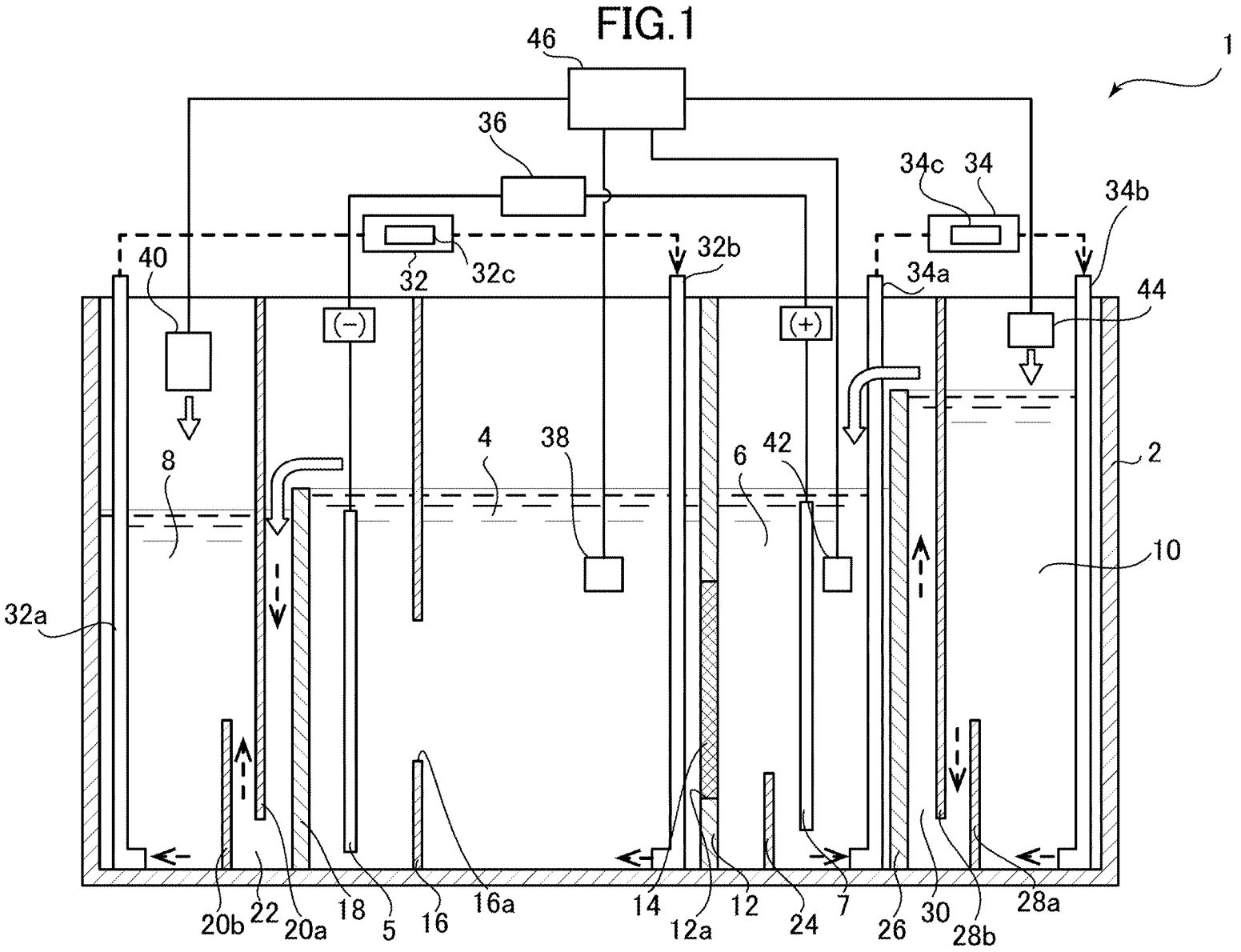
FIG. 1 is a cross-sectional view of a copper-nickel alloy electroplating apparatus according to a first embodiment of the present invention.

FIG. 1 is a cross-sectional view of a copper-nickel alloy electroplating apparatus according to a first embodiment of the present invention.

As shown in FIG. 1, the copper-nickel alloy electroplating apparatus 1 according to the first embodiment of the present invention includes a plating tank 2. The plating tank 2 is partitioned to form a cathode chamber 4, an anode chamber 6, a cathode chamber oxidation-reduction potential adjusting tank 8, and an anode chamber oxidation-reduction potential adjusting tank 10 therein.

In addition, a cathode 5 (workpiece) and an anode 7 are respectively placed in the cathode chamber 4 and the anode chamber 6 so as to be immersed in plating liquids.

A separation wall 12 is provided between the cathode chamber 4 and the anode chamber 6 to separate the cathode chamber 4 and the anode chamber 6 from each other. The separation wall 12 is provided with an opening portion 12*a*, and a diaphragm 14 is attached to the opening portion 12*a*.

The diaphragm 14 is configured to provide an electrically conductive partition between the cathode chamber 4 and the anode chamber 6. As the diaphragm 14, it is possible to use a cloth of polyester, polypropylene, KANEKALON, SARAN, PTFE, or the like, a neutral diaphragm such as one made of a polyethylene terephthalate substrate and membrane materials of polyvinylidene fluoride resin titanium oxide/sucrose fatty acid ester, or an ion exchange membrane such as a cation exchange membrane.

In addition, a cathode side shielding plate 16 is provided in the cathode chamber 4. The cathode side shielding plate 16 partitions the cathode chamber 4 into the diaphragm 14 side and the cathode 5 side. The cathode side shielding plate 16 is provided with an opening portion 16*a*. The provision of the cathode side shielding plate 16 prevents current concentration on peripheral portions of the cathode 5 (workpiece) and causes a uniform current to pass through every portion of the cathode 5, making it possible to obtain a uniform plating thickness and a uniform plating composition.

A cathode chamber weir portion 18 is provided between the cathode chamber 4 and the cathode chamber oxidation-reduction potential adjusting tank 8, and provides a partition therebetween. This configuration allows the plating liquid which is in the cathode chamber 4 and gets over the cathode chamber weir portion 18 to overflow into the cathode chamber oxidation-reduction potential adjusting tank 8.

In the cathode chamber oxidation-reduction potential adjusting tank 8, two partition walls 20*a* and 20*b* are provided. These partition walls 20*a* and 20*b* cause the plating liquid overflowing from the cathode chamber weir portion 18 to flow downward between the cathode chamber weir portion 18 and the partition wall 20*a*, turn at a bottom surface of the cathode chamber oxidation-reduction potential adjusting tank 8, and then flow upward between the partition walls 20*a* and 20*b*. In this manner, the plating liquid flows into the cathode chamber oxidation-reduction potential adjusting tank 8. In other words, the partition walls 20*a* and 20*b* form a turning passage 22 in the cathode chamber oxidation-reduction potential adjusting tank 8. This turning passage 22 creates a moderate flow of the plating liquid in the cathode chamber oxidation-reduction potential adjusting tank 8, and hence an oxidation-reduction potential adjusting agent introduced into the cathode chamber oxidation-reduction potential adjusting tank 8 is uniformly mixed, enabling smooth adjustment of the oxidation-reduction potential.

In the anode chamber 6, on the other hand, a sludge levee 24 is provided between the separation wall 12 and the anode 7. The sludge levee 24 is formed of a wall extending from a bottom surface of the anode chamber 6 to a predetermined height, and prevents deposited sludge from moving toward the separation wall 12.

An anode chamber weir portion 26 is provided between the anode chamber 6 and the anode chamber oxidation-reduction potential adjusting tank 10, and provides a partition therebetween. This configuration allows the plating liquid which is in the anode chamber oxidation-reduction potential adjusting tank 10 and gets over the anode chamber weir portion 26 to overflow into the anode chamber 6.

In the anode chamber oxidation-reduction potential adjusting tank 10, two partition walls 28*a* and 28*b* are provided. These partition walls 28*a* and 28*b* causes the plating liquid in the anode chamber oxidation-reduction potential adjusting tank 10 to get over the partition wall 28*a* and flow downward, turn at a bottom surface of the anode chamber oxidation-reduction potential adjusting tank 10, then flow upward between the partition wall 28*b* and the anode chamber weir portion 26, and overflow the anode chamber weir portion 26 into the anode chamber 6. In other words, the partition walls 28*a* and 28*b* form a turning passage 30 in the anode chamber oxidation-reduction potential adjusting tank 10. This turning passage 30 creates a moderate flow of the plating liquid in the anode chamber oxidation-reduction potential adjusting tank 10, and hence an oxidation-reduction potential adjusting agent introduced into the anode chamber oxidation-reduction potential adjusting tank 10 is uniformly mixed, enabling smooth adjustment of the oxidation-reduction potential.

Moreover, a cathode chamber transfer device 32 is provided between the cathode chamber 4 and the cathode chamber oxidation-reduction potential adjusting tank 8. The cathode chamber transfer device 32 transfers the plating liquid. The cathode chamber transfer device 32 is configured to suck the plating liquid through a cathode chamber suction pipe 32*a* opened at a bottom portion of the cathode chamber oxidation-reduction potential adjusting tank 8 by means of a pump (not-illustrated), and cause the plating liquid to flow into the cathode chamber 4 through a cathode chamber discharge pipe 32*b* opened at a bottom portion of the cathode chamber 4. In addition, the cathode chamber transfer device 32 houses a cathode chamber filter device 32*c* so as to remove sludge and the like contained in the plating liquid transferred by the cathode chamber transfer device 32.

Thus, the cathode chamber transfer device 32 transfers the plating liquid from the cathode chamber oxidation-reduction potential adjusting tank 8 to the cathode chamber 4, so that the liquid level of the plating liquid rises in the cathode chamber 4. Consequently, the plating liquid in the cathode chamber 4 overflows the cathode chamber weir portion 18 back to the cathode chamber oxidation-reduction potential adjusting tank 8. The combination of the cathode chamber weir portion 18 and the cathode chamber transfer device 32 as described above enables the plating liquid to circulate between the cathode chamber oxidation-reduction potential adjusting tank 8 and the cathode chamber 4 only by transferring the plating liquid from the cathode chamber oxidation-reduction potential adjusting tank 8 to the cathode chamber 4. Accordingly, the cathode chamber transfer device 32 and the cathode chamber weir portion 18 function as a cathode chamber circulation device that circulates the plating liquid in the cathode chamber 4 and in the cathode chamber oxidation-reduction potential adjusting tank 8 therebetween.

Next, an anode chamber transfer device 34 is provided between the anode chamber 6 and the anode chamber oxidation-reduction potential adjusting tank 10. The anode chamber transfer device 34 transfers the plating liquid. This anode chamber transfer device 34 is configured to suck the plating liquid through an anode chamber suction pipe 34*a* opened at a bottom portion of the anode chamber 6 by means of a pump (not-illustrated), and cause the plating liquid to flow into the anode chamber oxidation-reduction potential adjusting tank 10 through an anode chamber discharge pipe 34*b* opened at a bottom portion of the anode chamber oxidation-reduction potential adjusting tank 10. In addition, the anode chamber transfer device 34 houses an anode chamber filter device 34*c* so as to remove sludge and the like contained in the plating liquid transferred by the anode chamber transfer device 34.

Thus, the anode chamber transfer device 34 transfers the plating liquid from the anode chamber 6 to the anode chamber oxidation-reduction potential adjusting tank 10, so that the liquid level of the plating liquid rises in the anode chamber oxidation-reduction potential adjusting tank 10.

Consequently, the plating liquid in the anode chamber oxidation-reduction potential adjusting tank 10 overflows the anode chamber weir portion 26 back to the anode chamber 6. The combination of the anode chamber weir portion 26 and the anode chamber transfer device 34 as described above enables the plating liquid to circulate between the anode chamber 6 and the anode chamber oxidation-reduction potential adjusting tank 10 only by transferring the plating liquid from the anode chamber 6 to the anode chamber oxidation-reduction potential adjusting tank 10. Accordingly, the anode chamber transfer device 34 and the anode chamber weir portion 26 function as an anode chamber circulation device that circulates the plating liquid in the anode chamber 6 and in the anode chamber oxidation-reduction potential adjusting tank 10 therebetween.

Moreover, a power supply unit 36 is connected between the cathode 5 (workpiece) placed in the cathode chamber 4 and the anode 7 placed in the anode chamber 6. Upon activation of this power supply unit 36, a current flows from the anode 7 to the cathode 5 through the plating liquids and across the diaphragm 14, so that the workpiece is plated.

Next, a configuration for adjusting the oxidation-reduction potentials of the plating liquids is described.

A copper-nickel alloy electroplating apparatus 1 of this embodiment includes, as the configuration for adjusting the oxidation-reduction potentials: a cathode chamber electric potential measuring device 38; a cathode chamber adjusting agent addition device 40; an anode chamber electric potential measuring device 42; an anode chamber adjusting agent addition device 44; and a control unit 46 connected to the cathode chamber adjusting agent addition device 40 and the anode chamber adjusting agent addition device 44.

The cathode chamber electric potential measuring device 38 is placed in the cathode chamber 4 and is configured to measure the oxidation-reduction potential of the plating liquid in the cathode chamber 4.

The cathode chamber adjusting agent addition device 40 is configured to add an oxidation-reduction potential adjusting agent to the plating liquid in the cathode chamber oxidation-reduction potential adjusting tank 8.

Likewise, the anode chamber electric potential measuring device 42 is placed in the anode chamber 6 and is configured to measure the oxidation-reduction potential of the plating liquid in the anode chamber 6.

The anode chamber adjusting agent addition device 44 is configured to add an oxidation-reduction potential adjusting agent to the plating liquid in the anode chamber oxidation-reduction potential adjusting tank 10.

The cathode chamber electric potential measuring device 38 is connected to the control unit 46, and the oxidation-reduction potential measured by the cathode chamber electric potential measuring device 38 is inputted to the control unit 46. The control unit 46 is configured to control the cathode chamber adjusting agent addition device 40 on the basis of the inputted oxidation-reduction potential, to achieve a predetermined oxidation-reduction potential in the cathode chamber 4. The cathode chamber adjusting agent addition device 40 is configured to introduce a predetermined amount of the oxidation-reduction potential adjusting agent into the cathode chamber oxidation-reduction potential adjusting tank 8 on the basis of a control signal from the control unit 46.

Likewise, the anode chamber electric potential measuring device 42 is connected to the control unit 46, and the oxidation-reduction potential measured by the anode chamber electric potential measuring device 42 is inputted to the control unit 46. The control unit 46 is configured to control the anode chamber adjusting agent addition device 44 on the basis of the inputted oxidation-reduction potential, to achieve a predetermined oxidation-reduction potential in the anode chamber 6. The anode chamber adjusting agent addition device 44 is configured to introduce a predetermined amount of the oxidation-reduction potential adjusting agent into the anode chamber oxidation-reduction potential adjusting tank 10 on the basis of a control signal from the control unit 46.

The adjustment of the oxidation-reduction potentials by the control unit 46 is always carried out during the operation of the copper-nickel alloy electroplating apparatus 1.

Next, a copper-nickel alloy electroplating apparatus according to a second embodiment of the present invention is described with reference to FIG. 2.

Figure 2:
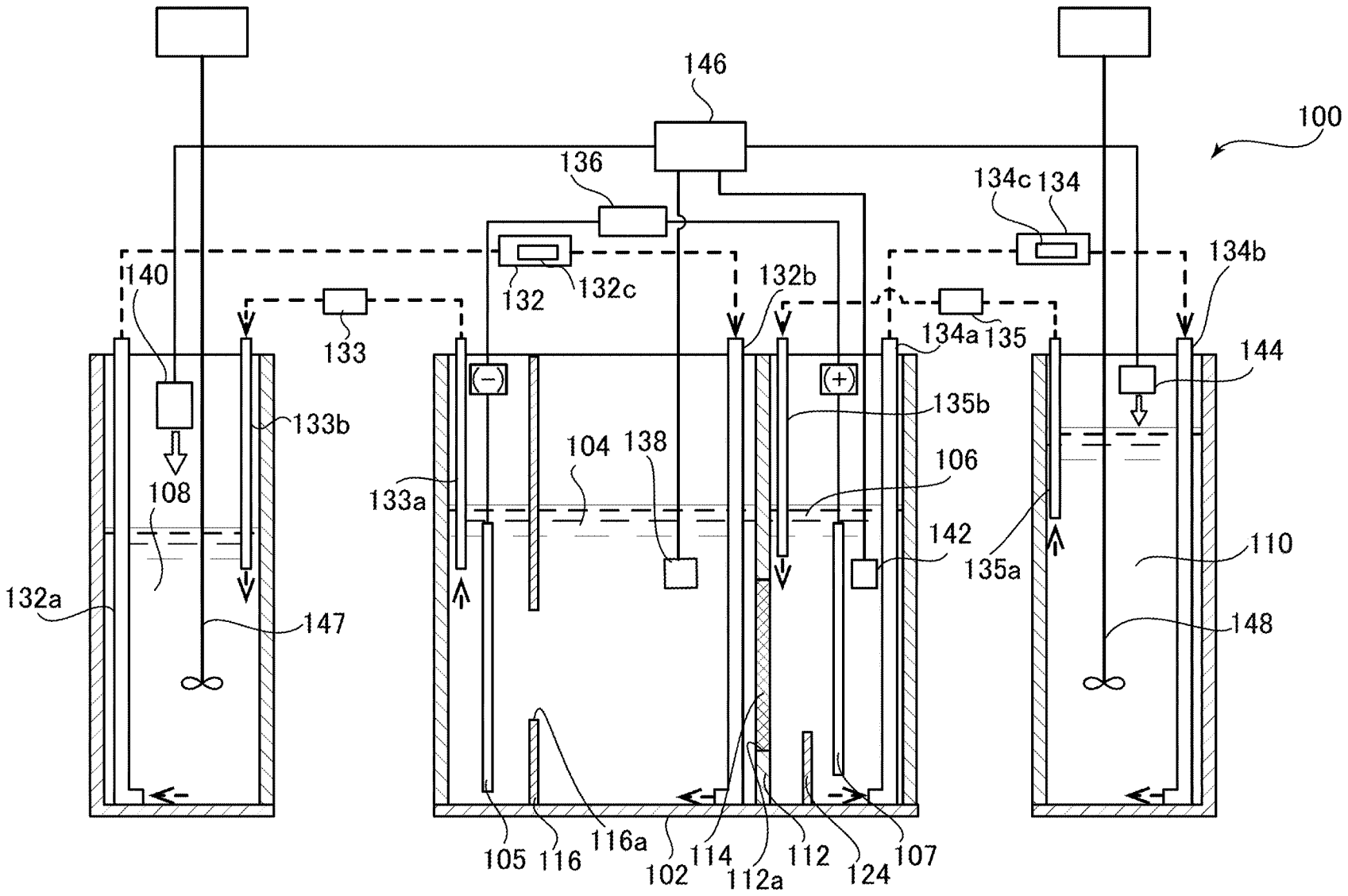
FIG. 2 is a cross-sectional view of a copper-nickel alloy electroplating apparatus according to a second embodiment of the present invention.

FIG. 2 is a cross-sectional view of the copper-nickel alloy electroplating apparatus according to the second embodiment of the present invention. In the above-described first embodiment, the cathode chamber 4 and the anode chamber 6 are respectively placed adjacent to the cathode chamber oxidation-reduction potential adjusting tank 8 and the anode chamber oxidation-reduction potential adjusting tank 10, and the plating liquid is circulated by overflow. This embodiment is different from the first embodiment in that the oxidation-reduction potential adjusting tanks are separately provided. Accordingly, differences between the second embodiment and the first embodiment of the present invention are described here, and common configurations, operations, and effects are not described.

As shown in FIG. 2, a copper-nickel alloy electroplating apparatus 100 of this embodiment includes a plating main tank 102, and a cathode chamber oxidation-reduction potential adjusting tank 108 and an anode chamber oxidation-reduction potential adjusting tank 110 which are separated from the plating main tank 102. In the plating main tank 102, a cathode chamber 104 and an anode chamber 106 are formed.

In addition, a cathode 105 (workpiece) and an anode 107 are respectively placed in the cathode chamber 104 and the anode chamber 106 to be immersed in the plating liquids.

A separation wall 112 is provided between the cathode chamber 104 and the anode chamber 106 to separate the cathode chamber 104 and the anode chamber 106 from each other. The separation wall 112 is provided with an opening portion 112*a*, to which a diaphragm 114 is attached.

In addition, a cathode side shielding plate 116 is provided in the cathode chamber 104. The cathode side shielding plate 116 partitions the cathode chamber 104 into the diaphragm 114 side and the cathode 105 side. This cathode side shielding plate 116 is provided with an opening portion 116*a*.

In the anode chamber 106, on the other hand, a sludge levee 124 is provided between the separation wall 112 and the anode 107. The sludge levee 124 is formed of a wall extending from a bottom surface of the anode chamber 106 to a predetermined height, and prevents deposited sludge from moving toward the separation wall 112.

The cathode chamber oxidation-reduction potential adjusting tank 108 is provided separately from the plating main tank 102, and is configured to circulate the plating liquid between the cathode chamber oxidation-reduction potential adjusting tank 108 and the cathode chamber 104. In addition, the cathode chamber oxidation-reduction potential adjusting tank 108 is provided with a propeller-type cathode chamber oxidation-reduction potential adjusting tank stirrer 147 to uniformly dissolve the oxidation-reduction potential adjusting agent introduced into the plating liquid.

The anode chamber oxidation-reduction potential adjusting tank 110 is provided separately from the plating main tank 102, and is configured to circulate the plating liquid between the anode chamber oxidation-reduction potential adjusting tank 110 and the anode chamber 106. In addition, the anode chamber oxidation-reduction potential adjusting tank 110 is provided with a propeller-type anode chamber oxidation-reduction potential adjusting tank stirrer 148 to uniformly dissolve the oxidation-reduction potential adjusting agent introduced into the plating liquid.

Piping and circulation pumps are disposed between the cathode chamber 104 and the cathode chamber oxidation-reduction potential adjusting tank 108 so that the plating liquids therein can circulate therebetween. Specifically, a cathode chamber first transfer device 132 is provided between the cathode chamber 104 and the cathode chamber oxidation-reduction potential adjusting tank 108. The cathode chamber first transfer device 132 returns the plating liquid in the cathode chamber oxidation-reduction potential adjusting tank 108 to the cathode chamber 104. The cathode chamber first transfer device 132 is configured to suck the plating liquid through a cathode chamber suction pipe 132*a* opened at a bottom portion of the cathode chamber oxidation-reduction potential adjusting tank 108 by means of a pump (not-illustrated), and cause the plating liquid to flow into the cathode chamber 104 through a cathode chamber discharge pipe 132*b* opened at a bottom portion of the cathode chamber 104. In addition, the cathode chamber first transfer device 132 houses a cathode chamber filter device 132*c* so as to remove sludge and the like contained in the plating liquid transferred by the cathode chamber first transfer device 132.

Moreover, a cathode chamber second transfer device 133 is provided between the cathode chamber 104 and the cathode chamber oxidation-reduction potential adjusting tank 108. The cathode chamber second transfer device 133 transfers the plating liquid in the cathode chamber 104 to the cathode chamber oxidation-reduction potential adjusting tank 108. The cathode chamber second transfer device 133 is configured to suck the plating liquid through a cathode chamber suction pipe 133*a* opened at an upper portion of the cathode chamber 104 by means of a pump (not-illustrated), and cause the plating liquid to flow into the cathode chamber oxidation-reduction potential adjusting tank 108 through a cathode chamber discharge pipe 133*b* opened at an upper portion of the cathode chamber oxidation-reduction potential adjusting tank 108.

Thus, the cathode chamber first transfer device 132 and the cathode chamber second transfer device 133 enable liquid circulation between the plating liquid in the cathode chamber 104 and the plating liquid in the cathode chamber oxidation-reduction potential adjusting tank 108.

Accordingly, the cathode chamber first transfer device 132 and the cathode chamber second transfer device 133 function as a cathode chamber circulation device that circulates the plating liquid in the cathode chamber 104 and in the cathode chamber oxidation-reduction potential adjusting tank 108 therebetween.

Piping and circulation pumps are disposed between the anode chamber 106 and the anode chamber oxidation-reduction potential adjusting tank 110 so that the plating liquids therein can circulate therebetween. Specifically, an anode chamber first transfer device 134 is provided between the anode chamber 106 and the anode chamber oxidation-reduction potential adjusting tank 110. The anode chamber first transfer device 134 transfers the plating liquid. The anode chamber first transfer device 134 is configured to suck the plating liquid through an anode chamber suction pipe 134*a* opened at a bottom portion of the anode chamber 106 by means of a pump (not-illustrated) and cause the plating liquid to flow into the anode chamber oxidation-reduction potential adjusting tank 110 through an anode chamber discharge pipe 134*b* opened at a bottom portion of the anode chamber oxidation-reduction potential adjusting tank 110. In addition, the anode chamber first transfer device 134 houses an anode chamber filter device 134*c* so as to remove sludge and the like contained in the plating liquid transferred by the anode chamber first transfer device 134.

Moreover, an anode chamber second transfer device 135 is provided between the anode chamber 106 and the anode chamber oxidation-reduction potential adjusting tank 110. The anode chamber second transfer device 135 returns the plating liquid in the anode chamber oxidation-reduction potential adjusting tank 110 to the anode chamber 106. The anode chamber second transfer device 135 is configured to suck the plating liquid through an anode chamber suction pipe 135*a* opened at an upper portion of the anode chamber oxidation-reduction potential adjusting tank 110 by means of a pump (not-illustrated), and cause the plating liquid to flow into the anode chamber 106 through an anode chamber discharge pipe 135*b* opened at an upper portion of the anode chamber 106.

Thus, the anode chamber first transfer device 134 and the anode chamber second transfer device 135 enable liquid circulation between the plating liquid in the anode chamber 106 and the plating liquid in the anode chamber oxidation-reduction potential adjusting tank 110. Accordingly, the anode chamber first transfer device 134 and the anode chamber second transfer device 135 function as an anode chamber circulation device that circulates the plating liquid in the anode chamber 106 and in the anode chamber oxidation-reduction potential adjusting tank 110 therebetween.

Moreover, a power supply unit 136 is connected between the cathode 105 (workpiece) placed in the cathode chamber 104 and the anode 107 placed in the anode chamber 106. Upon activation of this power supply unit 136, a current flows from the anode 107 to the cathode 105 through the plating liquids and across the diaphragm 114, so that the workpiece is plated.

In addition, the copper-nickel alloy electroplating apparatus 100 of this embodiment also includes, as a configuration for adjusting the oxidation-reduction potentials of the plating liquids: a cathode chamber electric potential measuring device 138; a cathode chamber adjusting agent addition device 140; an anode chamber electric potential measuring device 142; an anode chamber adjusting agent addition device 144; and a control unit 146 connected to the cathode chamber adjusting agent addition device 140 and the anode chamber adjusting agent addition device 144. Operations of these electric potential measuring devices to measure the oxidation-reduction potentials in the anode chamber 106 and the cathode chamber 104, and operations of the control unit 146 to control the adjusting agent addition devices and adjust the oxidation-reduction potentials on the basis of these measured values are the same as those in the above-described first embodiment, and hence description thereof is omitted.

Next, a plating bath (plating liquid) is described which is used in the copper-nickel alloy electroplating apparatuses according to the first and second embodiments of the present invention.

The copper-nickel alloy electroplating bath used in these embodiments comprises: (a) a copper salt and a nickel salt; (b) a metal complexing agent, (c) a conductivity providing salt, (d) a sulfur-containing organic compound, and (e) an oxidation-reduction potential adjusting agent.

(a) Copper Salt and Nickel Salt

The copper salt includes, but is not limited to, copper sulfate, copper(II) halides, copper sulfamate, copper methanesulfonate, copper(II) acetate, basic copper carbonate, and the like. These copper salts may be used alone, or may be used as a mixture of two or more thereof. The nickel salt includes, but is not limited to, nickel sulfate, nickel halides, basic nickel carbonate, nickel sulfamate, nickel acetate, nickel methanesulfonate, and the like. These nickel salts may be used alone, or may be used as a mixture of two or more thereof. The concentrations of the copper salt and the nickel salt in the plating bath have to be selected in various manners in accordance with the composition of a plated coating to be desired. However, the concentration of copper ions is preferably 0.5 to 40 g/L, and more preferably 2 to 30 g/L, and the concentration of nickel ions is preferably 0.25 to 80 g/L, and more preferably 0.5 to 50 g/L. In addition, the total concentration of copper ions and nickel ions in the plating bath is preferably 0.0125 to 2 mol/L, and more preferably 0.04 to 1.25 mol/L.

(b) Metal Complexing Agent

The metal complexing agent stabilizes metals, which are copper and nickel. The metal complexing agent includes, but is not limited to, monocarboxylic acids, dicarboxylic acids, polycarboxylic acids, oxycarboxylic acids, keto-carboxylic acids, amino acids, and amino carboxylic acids, as well as salts thereof, and the like. Specifically, the metal complexing agent includes malonic acid, maleic acid, succinic acid, tricarballylic acid, citric acid, tartaric acid, malic acid, gluconic acid, 2-sulfoethylimino-N,N-diacetic acid, iminodiacetic acid, nitrilotriacetic acid, EDTA, triethylenediaminetetraacetic acid, hydroxyethyliminodiacetic acid, glutamic acid, aspartic acid, β-alanine-N,N-diacetic acid, and the like. Among these, malonic acid, citric acid, malic acid, gluconic acid, EDTA, nitrilotriacetic acid, and glutamic acid are preferable. In addition, the salts of these carboxylic acids include, but are not limited to, magnesium salts, sodium salts, potassium salts, ammonium salts, and the like. These metal complexing agents may be used alone, or may be used as a mixture of two or more thereof. The concentration of the metal complexing agent in the plating bath is preferably 0.6 to 2 times, and more preferably 0.7 to 1.5 times, the metal ion concentration (molar concentration) in the bath.

(c) Conductivity Providing Salt

The conductivity providing salt provides electrical conductivity to the copper-nickel alloy electroplating bath. In the present invention, the conductivity providing salt includes inorganic halide salts, inorganic sulfates, lower alkane (preferably C1 to C4) sulfonates, and alkanol (preferably C1 to C4) sulfonates.

The inorganic halide salts include, but are not limited to, chloride salts, bromide salts, and iodized salts of magnesium, sodium, potassium, and ammonium, and the like. These inorganic halide salts may be used alone, or may be used as a mixture of two or more thereof. The concentration of the inorganic halide salt in the plating bath is preferably 0.1 to 2 mol/L, and more preferably 0.2 to 1 mol/L.

The inorganic sulfates include, but are not limited to, magnesium sulfate, sodium sulfate, potassium sulfate, ammonium sulfate, and the like. These inorganic sulfates may be used alone, or may be used as a mixture of two or more thereof.

The lower alkane sulfonates and the alkanol sulfonates include, but are not limited to, magnesium salts, sodium salts, potassium salts, ammonium salts, and the like, and more specifically include magnesium, sodium, potassium, and ammonium salts of methanesulfonic acid and 2-hydroxypropanesulfonic acid, and the like. These sulfonates may be used alone, or may be used as a mixture of two or more thereof.

The concentration of the sulfate and/or the sulfonate in the plating bath is preferably 0.25 to 1.5 mol/L, and more preferably 0.5 to 1.25 mol/L.

Moreover, it is more effective to use a plurality of conductivity providing salts different from each other as the conductivity providing salt. It is preferable to comprise an inorganic halide salt and a salt selected from the group consisting of inorganic sulfates and the sulfonates, as the conductivity providing salt.

(d) Sulfur-containing Organic Compound

The sulfur-containing organic compound preferably includes a compound selected from the group consisting of disulfide compounds, sulfur-containing amino acids, benzothiazolylthio compounds, and salts thereof.

The disulfide compound includes, but is not limited to, disulfide compounds represented by the general formula (I), and the like:

$$A\text{-}R^1\text{—S—S—}R^2\text{-}A \quad (I)$$

wherein $R^1$ and $R^2$ represent hydrocarbon groups, A represents a $SO_3Na$ group, a $SO_3H$ group, an OH group, a $NH_2$ group, or a $NO_2$ group.

In the formula, the hydrocarbon group is preferably an alkylene group, and more preferably an alkylene group having 1 to 6 carbon atoms. Specific examples of the disulfide compounds include, but are not limited to, bis-sodium sulfoethyl disulfide, bis-sodium sulfopropyl disulfide, bis-sodium sulfopentyl disulfide, bis-sodium sulfohexyl disulfide, bis-sulfoethyl disulfide, bis-sulfopropyl disulfide, bis-sulfopentyl disulfide, bis-aminoethyl disulfide, bis-aminopropyl disulfide, bis-aminobutyl disulfide, bis-aminopentyl disulfide, bis-hydroxyethyl disulfide, bis-hydroxypropyl disulfide, bis-hydroxybutyl disulfide, bis-hydroxypentyl disulfide, bis-nitroethyl disulfide, bis-nitropropyl disulfide, bis-nitrobutyl disulfide, sodium sulfoethyl propyl disulfide, sulfobutyl propyl disulfide, and the like. Among these disulfide compounds, bis-sodium sulfopropyl disulfide, bis-sodium sulfobutyl disulfide, and bis-aminopropyl disulfide are preferable.

The sulfur-containing amino acids include, but are not limited to, sulfur-containing amino acids represented by the general formula (II), and the like:

$$R\text{—S—}(CH_2)_n\text{CHNHCOOH} \quad (II)$$

wherein R represents a hydrocarbon group, or —H or —$(CH_2)_n$CHNHCOOH, and each n is independently 1 to 50.

In the formula, the hydrocarbon group is preferably an alkyl group, and more preferably an alkyl group having 1 to 6 carbon atoms. Specific examples of the sulfur-containing amino acids include, but are not limited to, methionine, cystine, cysteine, ethionine, cystine disulfoxide, cystathionine, and the like.

The benzothiazolylthio compounds include, but are not limited to, benzothiazolyl compounds represented by the general formula (III), and the like:

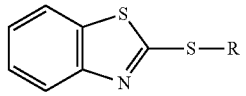

(III)

wherein R represents a hydrocarbon group, or —H or —$(CH_2)_n$COOH.

In the formula, the hydrocarbon group is preferably an alkyl group, and more preferably an alkyl group having 1 to 6 carbon atoms. In addition, n=1 to 5. Specific examples of the benzothiazolylthio compounds include, but are not limited to, (2-benzothiazolyl thio)acetic acid, 3-(2-benzothiazolyl thio)propionic acid, and the like. In addition, the salts thereof include, but are not limited to, sulfate, halide salt, methanesulfonate, sulfamate, acetate, and the like.

These disulfide compounds, sulfur-containing amino acids, and benzothiazolylthio compounds as well as the salts thereof may be used alone, or may be used as a mixture of two or more thereof. The concentration of a compound selected from the group consisting of disulfide compounds, sulfur-containing amino acids, and benzothiazolylthio compounds as well as the salts thereof in the plating bath is preferably 0.01 to 10 g/L, and more preferably 0.05 to 5 g/L.

In addition, it is more effective to use a compound selected from the group consisting of disulfide compounds, sulfur-containing amino acids, and benzothiazolylthio compounds as well as salts thereof, and a compound selected from the group consisting of sulfonic acid compounds, sulfimide compounds, sulfamic acid compounds, and sulfonamides as well as salts thereof in combination as the sulfur-containing organic compound. The use of a compound selected from the group consisting of sulfonic acid compounds, sulfimide compounds, sulfamic acid compounds, and sulfonamides as well as salts thereof in combination makes the copper-nickel alloy electroplated coating dense.

The sulfonic acid compounds and salts thereof include, but are not limited to, aromatic sulfonic acids, alkene sulfonic acids, and alkyne sulfonic acid as well as salts thereof. Specifically, the sulfonic acid compounds and salts thereof include, but are not limited to, sodium 1,5-naphthalenedisulfonate, sodium 1,3,6-naphthalenetrisulfonate, sodium 2-propene-1-sulfonate and the like.

The sulfimide compounds and salts thereof include, but are not limited to, benzoic sulfimide (saccharin) and salts thereof, and the like. Specifically, the sulfimide compounds and salts include, but are not limited to, saccharin sodium and the like.

The sulfamic acid compounds and salts thereof include, but are not limited to, acesulfame potassium, sodium N-cyclohexylsulfamate, and the like.

The sulfonamides and salts thereof include, but are not limited to, para-toluene sulfonamide and the like.

These sulfonic acid compounds, sulfimide compounds, sulfamic acid compounds, and sulfonamides as well as salts thereof may be used alone, or may be used as a mixture of two or more thereof. The concentration of a compound selected from the group consisting of sulfonic acid compounds, sulfimide compounds, sulfamic acid compounds, and sulfonamides as well as salts thereof in the plating bath is preferably 0.2 to 5 g/L, and more preferably 0.4 to 4 g/L.

(e) ORP Adjusting Agent

The oxidation-reduction potential adjusting agent is preferably an oxidant, and is, for example, an inorganic or organic oxidant. Such an oxidant includes, for example, hydrogen peroxide solutions, and water-soluble oxoacids, as well as salts thereof. The water-soluble oxoacids and salts thereof include inorganic and organic oxoacids.

When electroplating is performed by energizing between the cathode (workpiece) and the anode, divalent copper ions are deposited as metallic copper on the cathode by reduction reaction, and subsequently, the deposited metallic copper generates monovalent copper ions by dissolution reaction and the like. Then, the generation of such monovalent copper ions lowers the oxidation-reduction potential of the plating bath. The ORP adjusting agent is assumed to act as an oxidant for monovalent copper ions, which oxidizes monovalent copper ions to divalent copper ions, preventing the oxidation-reduction potential of the plating bath from being lowered.

Preferable inorganic oxoacids include halogen oxoacids such as hypochlorous acid, chlorous acid, chloric acid, perchloric acid, and bromic acid, and alkali metal salts thereof, nitric acid and alkali metal salts thereof, as well as persulfuric acid and alkali metal salts thereof.

Preferable organic oxoacids and salts thereof include aromatic sulfonates such as sodium 3-nitrobenzenesulfonate and percarboxylates such as sodium peracetate.

In addition, water-soluble inorganic compounds and organic compounds that are used also as pH buffers, as well as alkali metal salts thereof can also be used as the ORP adjusting agent. Such ORP adjusting agents include, preferably boric acid, phosphoric acid, and carbonic acid as well as alkali metal salts thereof, and the like, and also carboxylic acids such as formic acid, acetic acid, and succinic acid as well as alkali metal salts thereof, and the like.

Such ORP adjusting agents may each be used alone, or may be used as a mixture of two or more thereof. When the ORP adjusting agent is an oxidant, the oxidant is used, with the added amount being generally in a range of 0.01 to 5 g/L, and preferably in a range of 0.05 to 2 g/L. Meanwhile, when the ORP adjusting agent is a PH buffering agent, the PH buffering agent is used generally in a range of 2 to 60 g/L and preferably in a range of 5 to 40 g/L.

In the present invention, the oxidation-reduction potential (ORP) in the copper-nickel alloy electroplating bath needs to be constantly maintained at 20 mV (reference electrode (vs.) Ag/AgCl) or higher at a plating bath temperature, during plating operation. When the plating is being performed (during energizing), the oxidation-reduction potential normally decreases with time. In such case as well, the oxidation-reduction potential adjusting agent may additionally be added and used as appropriate to constantly maintain the oxidation-reduction potential (ORP) at 20 mV (vs. Ag/AgCl) or higher.

If the oxidation-reduction potential (ORP) in the bath becomes lower than or equal to 20 mV (vs. Ag/AgCl), deposition of plating becomes coarse, resulting in the formation of an uneven surface. Although there is no upper limit in the oxidation-reduction potential (ORP) in the bath, the ORP that is higher than or equal to 350 mV (vs. Ag/AgCl) is not favorable because such a high ORP affects organic substances contained in the bath, that is, (b) the metal complexing agent, (d) the sulfur-containing organic compound, and the like, thus lowering their effects, in some cases.

In the present invention, adding the surfactant to the copper-nickel alloy electroplating bath improves the uniformity of the plating composition and the smoothness of the plated surface. The surfactant includes water-soluble surfactants having a polymerizable group of an ethylene oxide or a propylene oxide, or a copolymerizable group of an ethylene oxide and a propylene oxide, as well as water-soluble synthetic polymers.

As the water-soluble surfactants, any of anionic surfactants, cationic surfactants, amphoteric surfactants, and nonionic surfactants may be used regardless of the ionicity, but nonionic surfactants are preferable. Although the water-soluble surfactants have a polymerizable group of an ethylene oxide or a propylene oxide, or a copolymerizable group of an ethylene oxide and a propylene oxide, the polymerization degree of these is 5 to 250, and preferably 10 to 150. These water-soluble surfactants may be used alone, or may be used as a mixture of two or more thereof. The concentration of the water-soluble surfactant in the plating bath is preferably 0.05 to 5 g/L, and more preferably 0.1 to 2 g/L.

The water-soluble synthetic polymers include reaction products of glycidyl ethers and polyvalent alcohols. The reaction products of glycidyl ethers and polyvalent alcohols make the copper-nickel alloy electroplated coating dense and further are effective in making the plating composition uniform.

The glycidyl ethers, which are reaction raw materials of the reaction products of glycidyl ethers and polyvalent alcohols, include, but are not limited to, glycidyl ethers containing two or more epoxy groups in molecule, glycidyl ethers containing one or more hydroxyl groups and one or more epoxy groups in molecule, and the like. Specifically, the glycidyl ethers include glycidol, glycerol polyglycidyl ether, ethylene glycol diglycidyl ether, polyethylene glycol diglycidyl ether, polypropylene glycol diglycidyl ether, sorbitol polyglycidyl ether, and the like.

The polyvalent alcohols include, but are not limited to, ethylene glycol, propylene glycol, glycerin, polyglycerin, and the like.

The reaction product of a glycidyl ether and a polyvalent alcohol is preferably a water-soluble polymer that is obtained by condensation reaction between an epoxy group of the glycidyl ether and a hydroxyl group of the polyvalent alcohol.

These reaction products of glycidyl ethers and polyvalent alcohols may be used alone, or may be used as a mixture of two or more thereof. The concentration of the reaction product of a glycidyl ether and a polyvalent alcohol in the plating bath is preferably 0.05 to 5 g/L, and more preferably 0.1 to 2 g/L.

In the present invention, although there is no particular limit in the pH of the copper-nickel alloy electroplating bath, the pH of the copper-nickel alloy electroplating bath is normally in a range of 1 to 13, and preferably in a range of 3 to 8. The pH of the plating bath may be adjusted by using a pH modifier such as sulfuric acid, hydrochloric acid, hydrobromic acid, methanesulfonic acid, sodium hydroxide, potassium hydroxide, ammonia water, ethylenediamine, diethylenetriamine, triethylenetetramine. When the plating operation is being performed, it is preferable to maintain the pH of the plating bath at a constant level by using the pH modifier.

Next, a plating method is described in which the copper-nickel alloy electroplating apparatus according to the first or second embodiment of the present invention is used. In this embodiment, the workpieces which can be electroplated by using the plating bath include copper, iron, nickel, silver, gold, alloys of any ones of them, and the like. Workpieces that can be electroplated by using the plating bath of the present invention include copper, iron, nickel, silver, gold, and alloys thereof, and the like. In addition, substrates having surfaces modified with the metal or alloy may be used as the workpiece. Such substrates include glass substrate, ceramic substrate, plastic substrate, and the like.

When electroplating is performed, insoluble anodes of carbon, platinum, platinum-plated titanium, indium oxide-coated titanium, and the like may be used as the anode. Alternatively, soluble anodes using copper, nickel, copper-nickel alloy, or both copper and nickel together, and the like may be used.

Moreover, for the electroplating in this embodiment, the substrate (cathode) to be plated and the anode electrode in the plating tank are separated from each other by the diaphragm 14. The diaphragm 14 is preferably a neutral diaphragm or an ion exchange membrane. The neutral membranes include one having a substrate of polyethylene terephthalate resin with a membrane material of poly vinylidene difluoride resin titanium oxide/sucrose fatty acid ester. In addition, as the ion-exchange membrane, a cation-exchange membrane is suitable.

The copper-nickel alloy electroplating bath of this embodiment makes it possible to obtain a plated coating at any composition with the copper/nickel component ratio in the deposited metal coating film being 5/95 to 99/1. The copper/nickel component ratio is preferably 20/80 to 98/2, and more preferably 40/60 to 95/5.

When plating is performed, the workpiece is brought to the plating step after being pre-treated by a conventional method. In the pre-treatment step, at least one operation of soak cleaning, electrolytic cleaning of the cathode or the anode, acid pickling, and activation is performed. Water cleaning is performed between every successive operations. After the plating, the coating thus obtained may be cleaned with water or hot water, and then dried. In addition, after the plating of a copper-nickel alloy, an anti-oxidation treatment or the plating of tin or a tin alloy, or the like may be performed. In the present invention, the plating bath is capable of being used for a long period of time without liquid updating, by maintaining the bath components at a constant level with an appropriate replenishing agent.

The thus prepared workpiece (cathode 5) is immersed in the plating liquid in the cathode chamber 4, and then the power supply unit 36 is activated to perform energization (electrolysis) between the anode 7 and the workpiece. In addition, the cathode chamber transfer device 32 is activated, and the plating liquid in the cathode chamber 4 and the cathode chamber oxidation-reduction potential adjusting tank 8 is circulated therebetween, while being filtered by the cathode chamber filter device 32*c*. Likewise, the anode chamber transfer device 34 is activated, and the plating liquid in the anode chamber 6 and the anode chamber oxidation-reduction potential adjusting tank 10 is circulated, while being filtered through the anode chamber filter device 34*c*. This makes it possible to remove sludge and the like in the plating liquids.

Moreover, the oxidation-reduction potential of the plating liquid in the cathode chamber 4 is measured by the cathode chamber electric potential measuring device 38, and is inputted to the control unit 46. The control unit 46 activates the cathode chamber adjusting agent addition device 40 to introduce the oxidation-reduction potential adjusting agent into the cathode chamber oxidation-reduction potential adjusting tank 8 so that the oxidation-reduction potential of the plating liquid in the cathode chamber 4 can have a predetermined value. Likewise, the oxidation-reduction potential of the plating liquid in the anode chamber 6 is measured by the anode chamber electric potential measuring device 42, and is inputted to the control unit 46. The control unit 46 activates the anode chamber adjusting agent addition device 44 to introduce the oxidation-reduction potential adjusting agent into the anode chamber oxidation-reduction potential adjusting tank 10 so that the oxidation-reduction potential of the plating liquid in the anode chamber 6 can have a predetermined value. Consequently, the oxidation-reduction potentials of the plating liquids in the cathode chamber 4 and the anode chamber 6 are maintained at suitable values.

Preferably, the bath components and the bath pH of the plating bath (plating liquid) are maintained constant with suitable replenishing agents. In addition, in this embodiment, the cathode chamber adjusting agent addition device 40 introduces the oxidation-reduction potential adjusting agent during the plating to make the oxidation-reduction potential (ORP) of the liquid in the cathode chamber 4 constantly 20 mV (vs. Ag/AgCl) or higher. Moreover, in this embodiment, the anode chamber adjusting agent addition device 44 introduces the oxidation-reduction potential adjusting agent to also make the oxidation-reduction potential (ORP) of the liquid in the anode chamber 6 constantly 20 mV (vs. Ag/AgCl) or higher. As the oxidation-reduction potential adjusting agent, a suitable amount of (1) an oxidant selected from inorganic oxidants and organic oxidants and/or a suitable amount of (2) inorganic and organic compounds having pH-buffering ability.

When electroplating is performed by using the copper-nickel alloy electroplating bath according to this embodiment, a direct current or a pulsed current can be used as a plating current to flow between the substrate to be plated and the anode 7 in the copper-nickel alloy electroplating bath.

The cathode current density is generally 0.01 to 10 A/dm$^2$, and preferably 0.1 to 8.0 A/dm$^2$.

The plating time varies depending on the required film thickness of the plating and the electric current conditions, and is generally in a range of 1 to 1200 minutes, and preferably in a range of 15 to 800 minutes.

The bath temperature is generally 15 to 70° C., and preferably 20 to 60° C. The bath can be stirrer by mechanical liquid stirring using air, liquid flow, a cathode rocker, a paddle (all of which are not illustrated), or the like. The film thickness may be in a wide range, and is generally 0.5 to 100 μm, and preferably 3 to 50 μm.

The copper-nickel alloy electroplating apparatus 1 of this embodiment performs copper-nickel alloy electroplating, while adjusting the oxidation-reduction potentials. Hence, the copper-nickel alloy electroplating apparatus 1 makes it possible to obtain a plated coating with a uniform composition, while depositing copper and nickel on a workpiece at any alloy ratio. Moreover, since the oxidation-reduction potentials are adjusted, the bath state can be maintained stable, and good copper-nickel alloy electroplated coating can be obtained, even when the plating bath (plating liquid) is continuously used for a long period.

Next, the present invention is described on the basis of Examples; however, the present invention is not limited thereto. It is possible to obtain a plated coating of a uniform composition on the above-described target workpiece at any copper-nickel alloy ratio over a wide current density range. In addition, the composition of the plating bath and plating conditions can be changed to any ones within the gist of obtaining copper-nickel alloy plating with excellent bath stability and with capability of being used continuously for a long period.

EXAMPLES

In Examples, the evaluation of plating was conducted by using test pieces each prepared by sealing, with Teflon (registered trademark) tape, one surface of a 0.5×50×50 mm iron plate (SPCC) on which cyanide bath copper strike plating was deposited in advance to a thickness of 0.3 μm.

Note that the film thickness of the copper strike plating on the test piece used for the evaluation was very thinner than the film thickness of the copper-nickel alloy electroplating, and hence the influences of the copper strike plating on the film thickness and on the alloy composition of the copper-nickel alloy electroplating are at negligible levels.

Examples 1 to 4 and Comparative Examples 1 to 4

Next, each of the plating liquids shown in Table 1 was (1) placed in the plating tank 2 in which the diaphragm 14 (polypropylene cloth) was disposed between the anode chamber 6 and the cathode chamber 4, (2) a copper plate anode (anode 7) was set in the anode chamber 6, and the above-described test piece (workpiece) was set in the cathode chamber 4, (3) circulation and filtration were conducted between the anode chamber 6 and the anode chamber oxidation-reduction potential adjusting tank 10, further (4) circulation and filtration were conducted between the cathode chamber 4 and the cathode chamber oxidation-reduction potential adjusting tank 8, (5) while the oxidation-reduction potentials (ORPs) were adjusted by the anode chamber oxidation-reduction potential adjusting tank 10 and the cathode chamber oxidation-reduction potential adjusting tank 8, energization was conducted between the cathode and the anode to perform plating under conditions of Table 2. Table 3 shows the results of the film thickness and the alloy composition of the obtained plating, the plated surface state and plating appearance evaluations (including color tone, smoothness, and glossiness).

Note that, in these Examples, aqueous hydrogen peroxide was used as the agent for adjusting the oxidation-reduction potentials (ORPs).

In addition, the film thickness and the alloy composition of the plating, the plated surface state, and the plating appearance were evaluated as follows.

1) The film thickness of the plating was measured with an X-ray fluorescence analyzer.

2) Regarding the alloy composition of the plating, the alloy compositions on cross-sections of the plating were measured with an energy-dispersive X-ray analyzer to evaluate the uniformity of the plated coating.

3) The plated surface state was evaluated by observation under a scanning electron microscope.

4) The plating appearance was visually observed.

In each of Comparative Examples, a plating liquid having the corresponding one of the compositions shown in Table 4 was 1) placed in a single tank which was not sectioned into the four chambers, that is, the anode chamber 6, the anode chamber oxidation-reduction potential adjusting tank 10, the cathode chamber 4, and the cathode chamber oxidation-reduction potential adjusting tank 8, (2) A copper plate was set as the anode, the above-described test piece, which was the same as that used in Examples, was set as the cathode, and energization was conducted between the cathode and the anode to conduct plating under conditions of Table 5. Table 6 shows the results of the film thickness and the alloy composition of the obtained plating, and the plated surface state and plating appearance evaluations (including color tone, smoothness, and glossiness).

TABLE 1

Compositions of Plating Liquids of Examples 1 to 4

| Concentrations of Components | Examples 1 | 2 | 3 | 4 |
|---|---|---|---|---|
| (a) $Cu^{2+}$ (g/L) | 5 | 5 | 10 | 15 |
| (a) $Ni^{2+}$ (g/L) | 10 | 2 | 10 | 5 |
| Concentration of Metals (mol/L) ($Cu^{2+}$ + $Ni^{2+}$) | 0.25 | 0.11 | 0.33 | 0.32 |
| (b) Malonic Acid (mol/L) | 0.38 | — | — | — |
| (b) Citric Acid (mol/L) | — | 0.08 | 0.23 | 0.22 |
| Metal Complexing Agent/Metal Molar Concentration Ratio (Fold) | 1.5 | 0.7 | 0.7 | 0.7 |
| (c) Sodium Chloride (mol/L) | 0.2 | — | 0.25 | — |
| (c) Potassium Bromide (mol/L) | — | 0.25 | — | 0.25 |
| (c) Magnesium Sulfate (mol/L) | — | — | — | 0.75 |
| (c) Sodium Methanesulfonate (mol/L) | — | — | 1.25 | — |
| (d) Bis-sodium Sulfopropyl Disulfide (g/L) | 0.05 | 0.1 | — | 0.5 |
| (d) Cysteine Methanesulfonate (g/L) | — | — | 2.0 | — |
| (d) Sodium 1,5-Naphthalenedisulfonate (g/L) | — | 2.0 | — | — |
| (d) Saccharin Sodium (g/L) | — | — | 2.0 | 1.0 |
| Reaction Product of Ethylene Glycol Diglycidyl Ether and Propylene Glycol (g/L) | — | — | — | 2.0 |
| Polyethylene Glycol (g/L) | — | 0.5 | — | — |
| pH | 4 | 6 | 5 | 6 |
| ORP Before Plating Energization (mV) | 300 | 256 | 280 | 176 |

Types of copper salts: copper (II) sulfamate (Example 1), copper(II) sulfate (Example 4), copper(II) acetate (Example 2), copper(II) methanesulfonate (Example 3)

Types of nickel salts: nickel sulfamate (Example 1), nickel sulfate (Example 4), nickel acetate (Example 2), nickel methanesulfonate (Example 3)

pH adjusting agents: sodium hydroxide (Examples 1, 2, and 3), potassium hydroxide (Example 4)

TABLE 2

Plating Conditions of Examples 1 to 4

| Items | | Plating Conditions | | | | |
|---|---|---|---|---|---|---|
| | | Cathode Current Density at Direct Current Portion or Peak Portion ($A/dm^2$) | Current Type | Plating Time (min) | Bath Temperature (° C.) | With/Without Stirring |
| Examples | 1 | 0.5<br>5.0<br>10 | Direct Current | 200<br>25<br>15 | 50 | With Stirring |
| | 2 | 0.5<br>5.0<br>10 | Direct Current | 200<br>25<br>15 | 65 | With Stirring |
| | 3 | 0.5<br>5.0<br>10 | Pulse Duty Ratio: 0.5 | 400<br>40<br>25 | 65 | With Stirring |
| | 4 | 0.5<br>5.0<br>10 | Direct Current | 200<br>25<br>12.5 | 50 | With Stirring |

TABLE 4

Compositions of Plating Liquids of Comparative Examples 1 to 4

| Concentrations of Components | Comparative Examples 1 | 2 | 3 | 4 |
|---|---|---|---|---|
| (a) $Cu^{2+}$ (g/L) | 5 | 5 | 10 | 15 |
| (a) $Ni^{2+}$ (g/L) | 10 | 2 | 10 | 5 |
| Concentration of Metals (mol/L) ($Cu^{2+}$ + $Ni^{2+}$) | 0.25 | 0.11 | 0.33 | 0.32 |
| (b) Malonic Acid (mol/L) | 0.38 | — | — | — |
| (b) Citric Acid (mol/L) | — | 0.08 | 0.23 | 0.22 |
| Metal Complexing Agent/Metal Molar Concentration Ratio (Fold) | 1.5 | 0.7 | 0.7 | 0.7 |
| (c) Sodium Chloride (mol/L) | 0.2 | — | 0.25 | — |
| (c) Potassium Bromide (mol/L) | — | 0.25 | — | 0.25 |
| (c) Magnesium Sulfate (mol/L) | 0.5 | — | — | 0.75 |
| (c) Sodium Methanesulfonate (mol/L) | — | — | 1.25 | — |
| (d) Bis-sodium Sulfopropyl Disulfide (g/L) | — | 0.1 | — | 0.5 |
| (d) Cysteine Methanesulfonate (g/L) | 0.05 | — | 2.0 | — |
| (d) Sodium 1,5-Naphthalenedisulfonate (g/L) | — | 2.0 | — | — |
| (d) Saccharin Sodium (g/L) | — | — | 2.0 | 1.0 |
| Reaction Product of Ethylene Glycol Diglycidyl Ether and Propylene Glycol (g/L) | — | — | — | 2.0 |
| Polyethylene Glycol (g/L) | — | 0.5 | — | — |
| pH | 4 | 6 | 5 | 6 |
| ORP Before Plating Energization (mV) | 300 | 256 | 280 | 176 |

Types of copper salts: copper(II) sulfamate (Comparative Example 1), copper(II) sulfate (Comparative Example 4),

TABLE 3

Results Obtained in Examples 1 to 4

| Items | | Obtained Results: Fresh Liquid at Initial Stage after Bath Preparation Plated Coating Evaluation · ORP during Plating | | | | | Liquid after Energization at 50 Ah/L Plated Coating Evaluation · ORP During Plating | | | | |
|---|---|---|---|---|---|---|---|---|---|---|---|
| | | Plating Film Thickness μm | Plating Composition Cu % | Appearance and Color Tone | Smoothness and Glossiness of Surface | ORP mV Vs. Ag/AgCl | Plating Film Thickness μm | Plating Composition Cu % | Appearance and Color Tone | Smoothness and Glossiness of Surface | ORP mV Vs. Ag/AgCl |
| Examples | 1 | 20 | 45 | Silver White | Semi-glossy | >150 | 20 | 47 | Silver White | Semi-glossy | >20 |
| | | 20 | 43 | Silver White | Semi-glossy | | 20 | 43 | Silver White | Semi-glossy | |
| | | 20 | 40 | Silver White | Semi-glossy | | 20 | 42 | Silver White | Semi-glossy | |
| | 2 | 20 | 85 | Cupronickel | Semi-glossy | >150 | 20 | 85 | Cupronickel | Semi-glossy | >50 |
| | | 20 | 82 | Cupronickel | Semi-glossy | | 20 | 83 | Cupronickel | Semi-glossy | |
| | | 20 | 80 | Cupronickel | Semi-glossy | | 20 | 83 | Cupronickel | Semi-glossy | |
| | 3 | 20 | 75 | Silver White | Semi-glossy | >140 | 20 | 74 | Silver White | Semi-glossy | >70 |
| | | 20 | 73 | Silver White | Semi-glossy | | 20 | 74 | Silver White | Semi-glossy | |
| | | 20 | 71 | Silver White | Semi-glossy | | 20 | 70 | Silver White | Semi-glossy | |
| | 4 | 20 | 97 | Coppery | Semi-glossy | >100 | 20 | 97 | Coppery | Semi-glossy | >50 |
| | | 20 | 94 | Coppery | Semi-glossy | | 20 | 95 | Coppery | Semi-glossy | |
| | | 20 | 92 | Coppery | Semi-glossy | | 20 | 93 | Coppery | Semi-glossy | |

copper(II) acetate (Comparative Example 2), copper(II) methanesulfonate (Comparative Example 3)

Types of nickel salts: nickel sulfamate (Comparative Example 1), nickel sulfate (Comparative Example 4), nickel acetate (Comparative Example 2), nickel methanesulfonate (Comparative Example 3)

pH adjusting agent: sodium hydroxide (Comparative Examples 1, 2, and 3), potassium hydroxide (Comparative Example 4)

TABLE 5

Plating Conditions of Comparative Examples 1 to 4

| Items | | Plating Conditions: Cathode Current Density at Direct Current Portion or Peak Portion ($A/dm^2$) | Current Type | Plating Time (min) | Bath Temperature (° C.) | With/Without Stirring |
|---|---|---|---|---|---|---|
| Comparative Examples | 1 | 0.5<br>5.0<br>10 | Direct Current | 200<br>25<br>15 | 50 | With Stirring |
| | 2 | 0.5<br>5.0<br>10 | Direct Current | 200<br>25<br>15 | 65 | With Stirring |
| | 3 | 0.5<br>5.0<br>10 | Pulse Duty Ratio: 0.5 | 400<br>40<br>25 | 65 | With Stirring |
| | 4 | 0.5<br>5.0<br>10 | Direct Current | 200<br>25<br>12.5 | 50 | With Stirring |

REFERENCE SIGNS LIST

1 copper-nickel alloy electroplating apparatus according to first embodiment of present invention
2 plating tank
4 cathode chamber
5 cathode (workpiece)
6 anode chamber
7 anode
8 cathode chamber oxidation-reduction potential adjusting tank
10 anode chamber oxidation-reduction potential adjusting tank
12 separation wall
12*a* opening portion
14 diaphragm
16 cathode side shielding plate
18 cathode chamber weir portion
20*a*, 20*b* partition walls
22 turning passage
24 sludge levee
26 anode chamber weir portion
28*a*, 28*b* partition walls
30 turning passage
32 cathode chamber transfer device
32*a* cathode chamber suction pipe
32*b* cathode chamber discharge pipe
32*c* cathode chamber filter device
34 anode chamber transfer device
34*a* anode chamber suction pipe
34*b* anode chamber discharge pipe
34*c* anode chamber filter device
36 power supply unit

TABLE 6

Results Obtained in Comparative Examples 1 to 4

| Items | | Obtained Results: Fresh Liquid at Initial Stage after Bath Preparation Plated Coating Evaluation · ORP during Plating: Plating Film Thickness μm | Plating Composition Cu % | Appearance and Color Tone | Smoothness and Glossiness of Surface | ORP mV Vs. Ag/AgCl | Liquid after Energization at 50 Ah/L Plated Coating Evaluation · ORP During Plating: Plating Film Thickness μm | Plating Composition Cu % | Appearance and Color Tone | Smoothness and Glossiness of Surface | ORP mV Vs. Ag/AgCl |
|---|---|---|---|---|---|---|---|---|---|---|---|
| Comparative Examples | 1 | 20 | 45 | Silver White | Semi-glossy | >130 | 20 | 95 | Coppery | Not Glossy | >−40 |
| | | 20 | 43 | Silver White | Semi-glossy | | 20 | 85 | Cupronickel | Not Glossy | |
| | | 20 | 40 | Silver White | Semi-glossy | | 20 | 45 | Silver White | Semi-glossy | |
| | 2 | 20 | 85 | Cupronickel | Semi-glossy | >130 | 20 | 95 | Coppery | Not Glossy | >−40 |
| | | 20 | 82 | Cupronickel | Semi-glossy | | 20 | 85 | Cupronickel | Not Glossy | |
| | | 20 | 80 | Cupronickel | Semi-glossy | | 20 | 83 | Cupronickel | Not Glossy | |
| | 3 | 20 | 75 | Silver White | Semi-glossy | >110 | 20 | 85 | Cupronickel | Not Glossy | >0 |
| | | 20 | 73 | Silver White | Semi-glossy | | 20 | 80 | Cupronickel | Not Glossy | |
| | | 20 | 71 | Silver White | Semi-glossy | | 20 | 75 | Silver White | Semi-glossy | |
| | 4 | 20 | 97 | Coppery | Semi-glossy | >90 | 20 | 100 | Bronze | Not Glossy | >−20 |
| | | 20 | 94 | Coppery | Semi-glossy | | 20 | 100 | Bronze | Not Glossy | |
| | | 20 | 92 | Coppery | Semi-glossy | | 20 | 100 | Bronze | Not Glossy | |

38 cathode chamber electric potential measuring device
40 cathode chamber adjusting agent addition device
42 anode chamber electric potential measuring device
44 anode chamber adjusting agent addition device
46 control unit
100 copper-nickel alloy electroplating apparatus of second embodiment of present invention
102 plating main tank
104 cathode chamber
105 cathode (workpiece)
106 anode chamber
107 anode
108 cathode chamber oxidation-reduction potential adjusting tank
110 anode chamber oxidation-reduction potential adjusting tank
112 separation wall
112*a* opening portion
114 diaphragm
116 cathode side shielding plate
116*a* opening portion
124 sludge levee
132 cathode chamber first transfer device
132*a* cathode chamber suction pipe
132*b* cathode chamber discharge pipe
133 cathode chamber second transfer device
133*a* cathode chamber suction pipe
133*b* cathode chamber discharge pipe
134 anode chamber first transfer device
134*a* anode chamber suction pipe
134*b* anode chamber discharge pipe
135 anode chamber second transfer device
135*a* anode chamber suction pipe
135*b* anode chamber discharge pipe
138 cathode chamber electric potential measuring device
140 cathode chamber adjusting agent addition device
142 anode chamber electric potential measuring device
144 anode chamber adjusting agent addition device
146 control unit
147 cathode chamber oxidation-reduction potential adjusting tank stirrer
148 anode chamber oxidation-reduction potential adjusting tank stirrer

The invention claimed is:

1. A copper-nickel alloy electroplating apparatus, comprising:

a cathode chamber in which a workpiece is to be placed;
a plating liquid in the cathode chamber;
an anode chamber;
an anode placed in the anode chamber;
a plating liquid in the anode chamber;
an electrically conductive diaphragm placed to separate the cathode chamber and the anode chamber from each other;
a cathode chamber oxidation-reduction potential adjusting tank for adjusting the oxidation-reduction potential of the plating liquid in the cathode chamber;
an anode chamber oxidation-reduction potential adjusting tank for adjusting the oxidation-reduction potential of the plating liquid in the anode chamber;
a power supply unit that provides an electric current to flow between the workpiece and the anode;
a cathode chamber electric potential measuring device that measures the oxidation-reduction potential of the plating liquid in the cathode chamber;
an anode chamber electric potential measuring device that measures the oxidation-reduction potential of the plating liquid in the anode chamber;
an oxidation-reduction potential adjusting agent in a cathode chamber adjusting agent addition device that adds the oxidation-reduction potential adjusting agent to the cathode chamber oxidation-reduction potential adjusting tank;
an oxidation-reduction potential adjusting agent in an anode chamber adjusting agent addition device that adds the oxidation-reduction potential adjusting agent to the anode chamber oxidation-reduction potential adjusting tank; and
a control unit that controls the cathode chamber adjusting agent addition device and the anode chamber adjusting agent addition device on the basis of the oxidation-reduction potential measured by the cathode chamber electric potential measuring device and the oxidation-reduction potential measured by the anode chamber electric potential measuring device;
wherein the plating liquid in the cathode chamber does not comprise the oxidation-reduction potential adjusting agent prior to adding the oxidation-reduction potential adjusting agent to the cathode chamber oxidation-reduction potential adjusting tank; and
wherein the plating liquid in the anode chamber does not comprise the oxidation-reduction potential adjusting agent prior to adding the oxidation-reduction potential adjusting agent to the anode chamber oxidation-reduction potential adjusting tank.

2. The electroplating apparatus according to claim 1, further comprising:

a cathode chamber circulation device that circulates the plating liquid in the cathode chamber and the cathode chamber oxidation-reduction potential adjusting tank therebetween; and
an anode chamber circulation device that circulates the plating liquid in the anode chamber and the anode chamber oxidation-reduction potential adjusting tank therebetween.

3. The electroplating apparatus according to claim 1, wherein the diaphragm is a cloth made of polyester, polypropylene, KANEKALON, SARAN, or PTFE, a neutral diaphragm, or an ion exchange membrane.

4. The electroplating apparatus according to claim 2, wherein the cathode chamber circulation device includes
a cathode chamber weir portion that allows the plating liquid in the cathode chamber to overflow into the cathode chamber oxidation-reduction potential adjusting tank,
a cathode chamber transfer device that transfers plating liquid in the cathode chamber oxidation-reduction potential adjusting tank to the cathode chamber, and
a cathode chamber filter device that filters the plating liquid transferred by the cathode chamber transfer device, and
the anode chamber circulation device includes
an anode chamber weir portion that allows plating liquid in the anode chamber oxidation-reduction potential adjusting tank to overflow into the anode chamber,
an anode chamber transfer device that transfers the plating liquid in the anode chamber to the anode chamber oxidation-reduction potential adjusting tank, and an anode chamber filter device that filters the plating liquid transferred by the anode chamber transfer device.

5. The electroplating apparatus according to claim 2, wherein the cathode chamber circulation device includes a cathode chamber first transfer device that transfers the plating liquid in the cathode chamber to the cathode chamber oxidation-reduction potential adjusting tank, a cathode chamber second transfer device that transfers plating liquid in the cathode chamber oxidation-reduction potential adjusting tank to the cathode chamber, and a cathode chamber filter device that filters the plating liquid circulated between the cathode chamber and the cathode chamber oxidation-reduction potential adjusting tank, and the anode chamber circulation device includes an anode chamber first transfer device that transfers plating liquid in the anode chamber oxidation-reduction potential adjusting tank to the anode chamber, an anode chamber second transfer device that transfers the plating liquid in the anode chamber to the anode chamber oxidation-reduction potential adjusting tank, and an anode chamber filter device that filters the plating liquid circulated between the anode chamber and the anode chamber oxidation-reduction potential adjusting tank.

6. The electroplating apparatus according to claim 1, further comprising a copper-nickel alloy electroplating liquid contained in the cathode chamber, the anode chamber, the cathode chamber oxidation-reduction potential adjusting tank, and the anode chamber oxidation-reduction potential adjusting tank, wherein the copper-nickel alloy electroplating liquid comprises (a) a copper salt and a nickel salt, (b) a metal complexing agent, (c) a conductivity providing salt, and (d) a sulfur-containing organic compound.

* * * * *